US006836978B1

(12) United States Patent
Lauer et al.

(10) Patent No.: US 6,836,978 B1
(45) Date of Patent: Jan. 4, 2005

(54) SHOE, ESPECIALLY SHOE FOR SMALL CHILDREN

(75) Inventors: Peter Lauer, Kleve (DE); Hubert Augustin, Geldern (DE); Ernst Klein, Reinsfeld (DE); Josef Schröder, Kleve (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/890,706

(22) PCT Filed: Feb. 7, 2000

(86) PCT No.: PCT/EP00/00940

§ 371 (c)(1),
(2), (4) Date: Oct. 25, 2001

(87) PCT Pub. No.: WO00/45660

PCT Pub. Date: Aug. 10, 2000

(30) Foreign Application Priority Data

Feb. 6, 1999 (DE) ..... 199 04 887

(51) Int. Cl.[7] ..... A43B 3/30; A43B 23/08; A43B 13/00; A43B 13/18

(52) U.S. Cl. ..... 36/102; 36/90; 36/112; 36/25 R; 36/58.6; 36/69

(58) Field of Search ..... 36/112, 90, 92, 36/102, 103, 25 R, 32 R, 58.6, 68, 69

(56) References Cited

U.S. PATENT DOCUMENTS

| | | | | | |
|---|---|---|---|---|---|
| 4,160,331 | A | * | 7/1979 | Bell | 36/59 B |
| 4,309,832 | A | | 1/1982 | Hunt | |
| 4,389,798 | A | * | 6/1983 | Tilles | 36/129 |
| 4,501,077 | A | * | 2/1985 | Young | 36/25 R |
| 4,538,366 | A | * | 9/1985 | Norton | 36/32 R |
| 4,551,930 | A | * | 11/1985 | Graham et al. | 36/32 R |
| 4,676,010 | A | * | 6/1987 | Cheskin | 36/32 R |
| 4,878,301 | A | * | 11/1989 | Kiyosawa | 36/69 |
| 4,939,853 | A | * | 7/1990 | Farbman | 36/103 |
| 5,024,007 | A | * | 6/1991 | DuFour | 36/25 R |
| 5,131,173 | A | * | 7/1992 | Anderie | 36/25 R |
| 5,224,279 | A | * | 7/1993 | Agnew | 36/32 R |
| 5,786,057 | A | * | 7/1998 | Lyden et al. | 36/25 R |
| 5,843,268 | A | * | 12/1998 | Lyden et al. | 36/25 R |
| 6,065,230 | A | * | 5/2000 | James | 36/25 R |
| 6,237,251 | B1 | * | 5/2001 | Litchfield et al. | 36/25 R |
| 6,321,469 | B1 | * | 11/2001 | Cretinon | 36/102 |
| 6,401,366 | B2 | * | 6/2002 | Foxen et al. | 36/102 |

FOREIGN PATENT DOCUMENTS

| | | |
|---|---|---|
| DE | 943 996 | 5/1956 |
| DE | 1 070 962 | 6/1960 |
| DE | 1 872 334 | 3/1963 |
| DE | 1 886 439 | 11/1963 |
| DE | 87 14 923 | 2/1988 |
| DE | 39 27 617 | 2/1991 |
| DE | 43 16 237 | 11/1997 |
| EP | 0 560 698 | 9/1993 |
| FR | 2 739 533 | 4/1997 |

* cited by examiner

*Primary Examiner*—Anthony Stashick
(74) *Attorney, Agent, or Firm*—Kenyon & Kenyon

(57) ABSTRACT

An improved shoe, promoting a heel-to-toe motion of a foot, comprising an outsole and an upper part. The outsole has a contraction extending to a first area where a back of the foot is located. The upper part has a heel guide, including one of a heelplate and a flexible heel brace, which are arranged in a second area where the heel of the foot is located, such that an Achilles tendon of the foot is free.

13 Claims, 2 Drawing Sheets

SHOE, ESPECIALLY SHOE FOR SMALL CHILDREN

This application is a 371 of PCT/EP00/00940 filed Feb. 7, 2000.

FIELD

The present invention relates to a shoe for promoting a heel-to-toe motion of a foot.

BACKGROUND INFORMATION

Already in German Patent C 10 70 962, it was established that the rotational mobility of the heel part of the sole with respect to the forward part of the sole, in the sense of a wringing, is essential for an undisturbed sequence of development of the foot. In addition, in that publication it is described as known that the insole and/or the outsole of the footwear are provided in the area of the articulated point with cutouts that proceed from the edges of the sole and that may be filled by inserts, which may be made of a more pliant material than that of the in- or outsole. In the area of the articulated point the width of the sole, which is furnished with the inserts, corresponds roughly to the dimensions that are established by the vertical projection of the foot, so that the foot is protected by the base of the shoe. The overall depth of these cutouts may be smaller than the overall width of the sole in the area of the articulation, the cutouts being wider in the area of the edge of the sole than in the area of the interior of the sole. In place of a single cutout, it may be also possible to assign to each edge of the sole a plurality of cutouts running roughly transverse to the longitudinal direction of the sole, whose edges, bordering a cutout, essentially run parallel to each other and whose width corresponds at least to the thickness of the sole.

On the upper side of the sole a molded footbed support may be arranged, which may be bonded in one piece to the material of the inserts that fill out the cutouts. The cutouts here may be situated mainly on the outer edge of the foot, so that the sole of the forward area of the foot is connected via a roughly centered crosspiece to the outsole of the rear area of the foot.

From German Patent U 87 14 923, it is known to use anatomically shaped shoe soles, which are anatomically formed in a natural way in accordance with the imprint of a healthy foot and which can be used for all shoes. It can be seen from the drawing that the sole in the area of the transition between the heel and the forefoot may not be shaped in accordance with the outline of the foot, but rather in accordance with its contact surface. Therefore, in this area, there may be a reduction in the width. The problem of rotational mobility is not described.

From German Patent C 43 16 237, it is also known that a reinforcing element may be provided made of a fibrous material, which may be configured as a supporting plate and which also traces the foot contact surface in the area of the outer edge of the foot.

Despite the measures proposed here, it is believed that there remains a need for improvement in promoting unhindered physiological movement of the foot in all motions:

SUMMARY OF THE INVENTION

According to an exemplary embodiment of the present invention, the outsole in the area of the contraction has a connecting piece having a degree of flexibility such that a torsion of the front of the foot with regard to the back of the foot is impeded as little as possible, and high flexibility in the area of the front of the foot is provided to the outsole regarding the motion of the foot, as a result of an appropriate profiling.

It is believed that a combination of an increased rotational mobility in the heel part of the sole with respect to the forward part of the sole, together with a zone of high flexibility in the ball of the foot area of the front of the foot, promotes the physiological heel to toe of the foot in all motions. In contrast to the related art, in which the flexibility is determined by the material selected and by the thickness of the sole, the flexibility of the sole according to an aspect of the above exemplary embodiment of the present invention is primarily achieved through the geometric configuration of the sole.

According to a further aspect of the above exemplary embodiment of the present invention, the contraction is be configured such that the area of the outsole in the front of the foot is connected via a crosspiece to the area of the outsole in the back of the foot. As a result, a single-piece injection-molding of the sole is possible.

It is believed that the above exemplary embodiment of the shoe according to the present invention is particularly suitable as a shoe for small children, because it supports the first steps of the small child while making possible the natural play of the toes, as a result of which the foot can move in a natural manner. It is further believed that the above exemplary embodiment of the shoe according to the present invention advantageously supports the development of the foot in a natural way and, especially as a shoe when learning to walk, promotes the first steps of a small child.

According to a further aspect of the above exemplary embodiment of the present invention, advantageously, the profiling is executed in the form of parallel or ray-shaped grooves, which extend at least partially over the width of the shoe.

According to a further aspect of the above exemplary embodiment of the present invention, the extension extends over the entire width of the shoe. It is believed that the extension over the entire width of the shoe is particularly advantageous, allowing in a variant of this aspect of the above exemplary embodiment of the present invention the profiling to be made of a plurality of materials of differing elasticities. As a result, it is possible to increase the flexibility overall while maintaining the necessary minimum thickness for manufacturing the sole and for achieving a sufficient stability of the sole.

According to a further aspect of the above exemplary embodiment of the present invention, advantageously, the contraction of the outsole is arranged on the interior side of the shoe, because the movement of the foot in rolling from heel to toe is particularly pronounced in this area.

According to a further aspect of the above exemplary embodiment of the present invention, the contraction is extended into the area of the back of the foot, so that if a shoe heel is present, it is even partially chamfered. It is believed that a greater flexibility is achieved as a result.

According to a further aspect of the above exemplary embodiment of the present invention, the thickness of the outsole is advantageously reduced to the thickness required for manufacturing, which is believed to improve the flexibility. According to a further aspect of the above exemplary embodiment of the present invention, in addition to an anatomically shaped footbed, a heelplate or a flexible heel brace is provided for a heel guide, which is advantageously configured so that the Achilles tendon is free, which is believed to give the foot sufficient support despite the elastic sole.

According to a further aspect of the above exemplary embodiment of the present invention, the outsole in the area in the back of the foot has a heel, which is believed to improve the position of the foot. According to a variant of this aspect of the above exemplary embodiment of the present invention, this heel extends under the heel bone of the child's foot in the direction of the forefoot and is narrowed in the area of the interior of the foot as a result of the contraction.

BRIEF DESCRIPTION OF THE DRAWINGS

In the drawings, a children's shoe according to exemplary embodiments of the present invention is depicted. The following are the contents.

DETAILED DESCRIPTION

Figure 1:
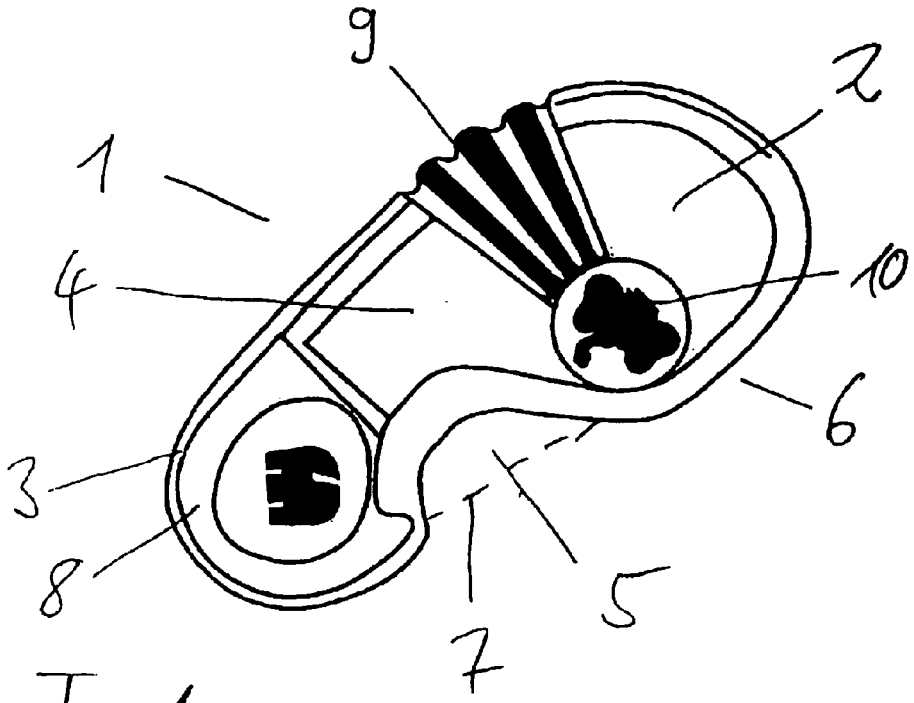
FIG. 1 shows an exemplary embodiment of a children's shoe according to the present invention in a view from below.

FIG. 1 depicts the lower side of a outsole 1. Outsole 1 is subdivided into an area in the forefoot 2 and an area in the back of the foot 3, which are connected to each other by a connecting area 4. Connecting area 4 arises as a result of a contraction 5 on interior side 6 of foot 7, whose contour is indicated by dotted line. Also running along this dotted-line contour is the undepicted upper part, that extends underneath the foot, so that in the area of contraction 5 the upper part is without any covering from below by sole 1.

In area 3 in the back of the foot, a heel 8 is arranged, which is partially cut out in the area of contraction 5. Heel 8 offers protection against slipping in climbing or going up stairs. In area 2 in the forefoot, a profiling 9 is provided, which extends from presupposed position 10 of the ball of the foot on interior side 6 of the foot to the exterior side of the foot.

Due to contraction 5, connecting area 4 is configured in a reduced width with respect to the projection surface of the foot, and in the depicted exemplary embodiment it is narrowed only on interior side 6 of the foot. However, it is advantageous to provide an appropriate contraction also on the exterior side of the foot. In this way, a connecting piece between the area of the forefoot and the area of the back of the foot arises.

Figure 2:
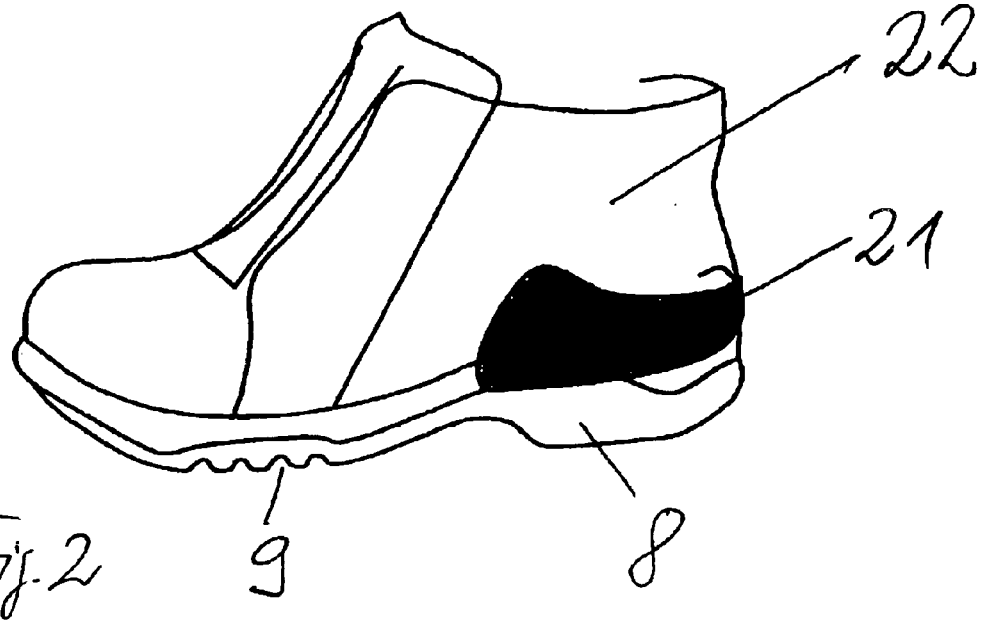
FIG. 2 shows the children's shoe from FIG. 1 in a side view emphasizing a reinforced heel area.

In order to assure the foot sufficient support in the shoe despite the very flexible outsole, a heelplate or stiffener 21 is provided, which is depicted in FIG. 2 and which is arranged in an upper part 22, the heelplate extending downwards in the area of the Achilles tendon, so that the Achilles tendon is free, the heelplate nevertheless being pulled up in the area of the front of the heel bone and extending beyond heel 8 to the exterior edge of the foot. Alternatively, a heel brace arranged on the exterior can also be used to generate an improved connection of the shoe to the foot in the heel area.

Figure 3:
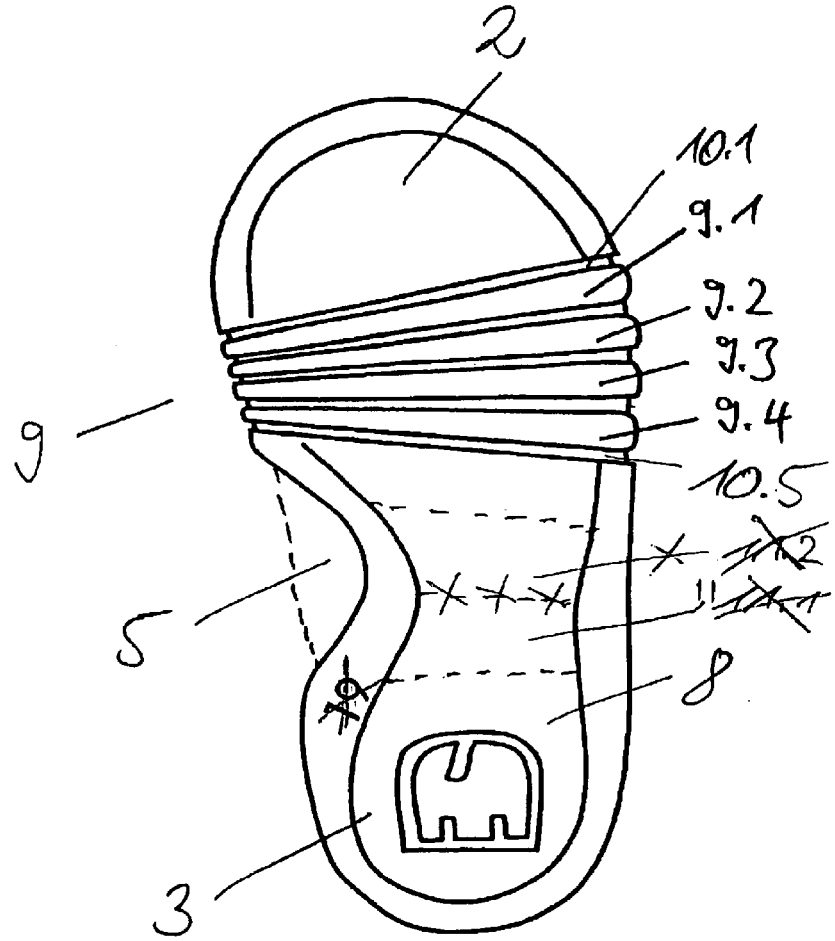
FIG. 3 shows a further exemplary embodiment of a children's shoe according to the present invention in a view from below.

The children's shoe depicted in FIG. 3, in the area of the toe joint, i.e., at the transition between the middle of the foot and the toes, has a profiling 9, extending over the entire width, in the form of crosspieces 9.1–9.4 and grooves 10.1–10.5. Taken together with contraction 5, a shoe of great flexibility is achieved in this manner, which little hinders the torsion of the foot and otherwise favors the motion of the foot in the area of the forefoot.

Figure 4:
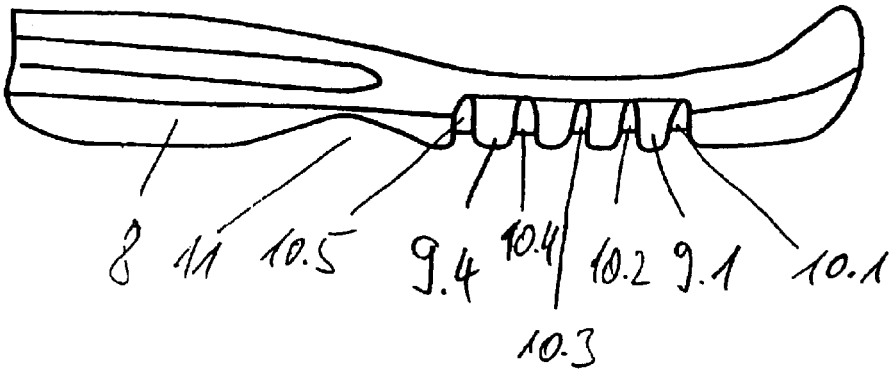
FIG. 4 shows an enlargement of the sole of the children's shoe from FIG. 3 in a side view.

In FIG. 4, an enlargement of the sole of the children's shoe from FIG. 3 is depicted in a side view of the exterior side of the shoe. Profiling 9 can be seen in the form of crosspieces 9.1–9.4 and grooves 10.1–10.5, which can be filled at least partially by a second material. This embodiment has less bending resistance and therefore contributes to the plasticity while at the same time assuring a sufficient thickness of the sole for protecting the foot.

Crosspieces 9.1–9.4 widen in the direction of the exterior edge of the shoe, so that, over the width of the shoe, in response to the motion of the foot, the exterior edge of the shoe has less bending resistance in the sole than the interior edge of the shoe.

Beginning from heel 8, the thickness of the sole decreases not only as a result of the contraction, which is not visible in this representation, but also as a result of the reduction in the thickness of the sole in area 11.

It is furthermore essential for comprehending the exemplary embodiments of the present invention, that the upper part of the shoe in the area of contraction 5 on the lower side of the shoe remains free, i.e., not covered by the sole. In the area of the exterior side of the foot, it is possible to configure the contraction as an arch that is covered only by a thin layer of sole material.

What is claimed is:

1. A shoe for promoting a heel-to-toe motion of a foot, the shoe comprising:

an outsole;

an upper part;

wherein the outsole has a contraction, the contraction extending to a first area where a back of the foot is located;

wherein a heel guide for a heel of the foot is provided in the upper part, the heel guide having one of a heelplate and a flexible heel brace;

wherein the one of the heelplate and the flexible heel brace are arranged in a second area where the heel of the foot is located and having a smaller height above the outsole in an area of an Achilles tendon of the foot than in the area of a front heel bone of the foot;

wherein the one of the heelplate and the flexible heel brace are configured such that the Achilles tendon of the foot is free;

wherein in an area of the front of the foot the outsole has a profiling configured to provide for a great flexibility of the outsole with regard to the heel-to-toe motion of the foot.

2. The shoe according to claim 1, wherein the contraction in the outsole is in a third area between where a forefoot of the foot is located and where the back of the foot is located.

3. The shoe according to claim 1, wherein the outsole has a connecting area adjacent to the contraction.

4. The shoe according to claim 1, wherein the profiling has one of parallel grooves and ray-shaped grooves, the one of the parallel grooves and the ray-shaped grooves extending at least partially over a width of the shoe.

5. The shoe according to claim 4, wherein the one of the parallel grooves and the ray-shaped grooves extend over the entire width of the shoe.

6. The shoe according to claim 1, wherein the profiling is made up of at least two materials having different elasticities.

7. The shoe according to claim 1, wherein the contraction of the outsole is arranged on an inner side of the shoe.

8. The shoe according to claim 1, wherein the contraction of the outsole is arranged on an outer side of the shoe.

9. The shoe according to claim 7, wherein the outsole has a further contraction, the further contraction being arranged on an outer side of the shoe.

10. The shoe according to claim 1, wherein the outsole is provided with a heel in the first area.

11. The shoe according to claim 4, wherein the profiling is made up of at least two materials having different elasticities.

12. The shoe according to claim 5, wherein the profiling is made up of at least two materials having different elasticities.

13. The shoe according to claim 1, wherein the outsole has a connecting area adjacent to the contraction configured to minimize torsion of a forefoot with respect to the back of the foot.

* * * * *